US011067921B2

(12) United States Patent
Kusakabe

(10) Patent No.: US 11,067,921 B2
(45) Date of Patent: Jul. 20, 2021

(54) IMAGE FORMING DEVICE, AND SETTING METHOD AND NON-TRANSITORY RECORDING MEDIUM THEREFOR

(71) Applicant: Konica Minolta, Inc., Tokyo (JP)

(72) Inventor: Kazushi Kusakabe, Aichi (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/888,550

(22) Filed: May 29, 2020

(65) Prior Publication Data

US 2020/0393781 A1 Dec. 17, 2020

(30) Foreign Application Priority Data

Jun. 13, 2019 (JP) ..... JP2019-110010

(51) Int. Cl.

| | |
|---|---|
| ***G03G 15/16*** | (2006.01) |
| ***G03G 21/18*** | (2006.01) |
| ***G03G 15/00*** | (2006.01) |
| *G03G 21/16* | (2006.01) |

(52) U.S. Cl.

CPC ..... *G03G 15/1605* (2013.01); *G03G 15/553* (2013.01); *G03G 21/1878* (2013.01); *G03G 21/168* (2013.01); *G03G 21/1842* (2013.01); *G03G 2221/1654* (2013.01); *G03G 2221/1663* (2013.01)

(58) Field of Classification Search

CPC .. G03G 15/1605; G03G 15/55; G03G 15/553; G03G 21/1875; G03G 21/1878; G03G 2221/1663; G03G 2221/1675; G03G 21/168; G03G 2215/00139; G03G 15/161; G03G 21/1842; G03G 2221/1654

See application file for complete search history.

(56) References Cited

U.S. PATENT DOCUMENTS

| | | | | |
|---|---|---|---|---|
| 2016/0216650 | A1* | 7/2016 | Hatano | G03G 15/1615 |
| 2017/0052502 | A1* | 2/2017 | Pearce | G03G 21/0005 |
| 2017/0371287 | A1* | 12/2017 | Hatanaka | G03G 21/0011 |
| 2018/0120744 | A1 | 5/2018 | Yamaki et al. | |
| 2018/0120748 | A1 | 5/2018 | Shibuya et al. | |
| 2020/0264818 | A1* | 8/2020 | Okuzumi | G06F 3/1231 |

FOREIGN PATENT DOCUMENTS

| | | |
|---|---|---|
| JP | 2018/072602 A | 5/2018 |
| JP | 2018/072603 A | 5/2018 |

* cited by examiner

*Primary Examiner* — Walter L Lindsay, Jr.
*Assistant Examiner* — Laura Roth
(74) *Attorney, Agent, or Firm* — Squire Patton Boggs (US) LLP

(57) ABSTRACT

An image forming device may include an image unit which in turn may include an image carrier, and a transfer unit arranged adjacent to the image carrier. A controller sets a usable period of the image unit based on a relative positional relation between the image unit and the transfer unit. The controller further: obtains first positional information related to the image unit and second positional information related to the transfer unit, identifies the relative positional relation between the image unit and the transfer unit based on the obtained first and second positional information.

23 Claims, 11 Drawing Sheets

IMAGE FORMING DEVICE, AND SETTING METHOD AND NON-TRANSITORY RECORDING MEDIUM THEREFOR

Japenese patent application No. 2019-110010 filed on Jun. 13, 2019 including description, claims, drawings, and abstract the entire disclosure is incorporated herein by reference in its entirety.

BACKGROUND

Technological Field

The present invention relates to an image forming device, a setting method and a non-transitory recording medium. One or more embodiments of the present invention more specifically relate to a technique for setting a usable period of an image unit which includes an image carrier.

Description of the Related Art

An electrophotographic image forming device is provided with an image carrier having a photosensitive layer on a cylindrical surface. A cleaning blade, an electrifying unit and a developing unit are arranged around the image carrier, and an image unit is formed integrally with the image carrier. The life of the image unit runs out due to a wear of the photosensitive layer formed on the surface of the image carrier. A tip part of the cleaning blade is in contact with the surface of the photosensitive layer, for instance. When the image carrier is rotated and driven in response to a processing of a print job, the photosensitive layer is worn out little by little due to rubbing by the cleaning blade. The photosensitive layer is also worn as the image carrier touches an intermediate transfer belt. In order to enhance an efficiency for transferring a toner image from the image carrier to the intermediate transfer belt, for example, there is a certain value of difference between a speed of the intermediate transfer belt and a rotation speed of the image carrier. The difference between the speed of the intermediate transfer belt and the speed of the image carrier produces a friction on the surface of the image carrier, and the photosensitive layer is worn out little by little. When the photosensitive layer is worn out more than a predetermined amount, a noise may be occurred in the image in printing. In this case, the image unit should be replaced.

As a conventional way of figuring out a replacement time of the image unit, a rotation number of the image carrier or the number of the printed output is recorded, for example. When the rotation number or the number of the printed output reaches a predetermined value, it is determined it is the time for the replacement. Also, an electronic current flew from the electrifying unit to the image carrier is detected, and an amount of change in the electronic current is measured so that the replacement time is detected. This known technique is introduced for example in Japanese Patent Application Laid-Open No. JP 2018-072603 A.

According to the known technique, however, when the rotation number or the number of the printed output reaches the predetermined value or the amount of change in the electronic current reaches a predetermined value, the replacement time of the image unit is determined. In this case, variations in each part provided with the individual image unit are not considered, and the replacement time cannot be determined correctly. The intermediate transfer belt, for instance, is arranged to be pressed to a surface of the photosensitive layer by a primary transfer roller arranged at a position facing the image carrier. The primary transfer roller presses the intermediate transfer belt to the surface of the image carrier so that a transfer pressure is applied between the intermediate transfer belt and the image carrier. The toner image is then primarily transferred from the image carrier to the intermediate transfer belt. There, however, may be variations in positions at which the image carrier is arranged in the image unit, or variations in positions at which the primary transfer roller is arranged. In this case, the transfer pressure applied from the primary transfer roller to the image carrier varies. This causes variation in friction produced between the intermediate transfer belt and the surface of the image carrier. This also causes variation in a wear degree of the photosensitive layer. In order to determine the replacement time of the image unit correctly, variations in parts provided with each image unit should be considered. It is preferable to appropriately know the wear degree of the photosensitive layer at a time when the image unit is arranged to the image forming device.

SUMMARY

One or more embodiments provide an image forming device, a setting method and a non-transitory recording medium that are enabled to set an appropriate replacement time corresponding to an individual image unit.

In one aspect, the present invention is directed to an image forming device.

According to an aspect of the present invention, the image forming device comprises: an image unit comprising an image carrier; a transfer unit arranged adjacent to the image carrier; and a controller sets a usable period of the image unit based on a relative positional relation between the image unit and the transfer unit.

In another aspect, the present invention is directed to a setting method to set a usable period of an image unit.

According to an aspect of the present invention, the setting method is applied at an image forming device comprising: the image unit comprising an image carrier; and a transfer unit arranged adjacent to the image unit. The method comprises: setting the usable period of the image unit based on a relative positional relation between the image unit and the transfer unit.

In another aspect, the present invention is directed to a non-transitory recording medium storing a computer readable program to be executed by a hardware processor in an image forming device comprising: an image unit comprising an image carrier; and a transfer unit arranged adjacent to the image carrier.

According to an aspect of the present invention, the non-transitory recording medium storing a computer readable program to be executed by the hardware processor in the image forming device causing the hardware processor to perform: set a usable period of the image unit based on a relative positional relation between the image unit and the transfer unit.

BRIEF DESCRIPTION OF THE DRAWING

The advantages and features provided by one or more embodiments of the invention will become more fully understood from the detailed description given herein below and the appended drawings which are given by way of illustration only, and thus are not intended as a definition of the limits of the present invention.

DETAILED DESCRIPTION OF EMBODIMENTS

Hereinafter, embodiments of the present invention will be described with reference to the drawings. However, the scope of the invention is not limited to the disclosed embodiments.

Figure 1:
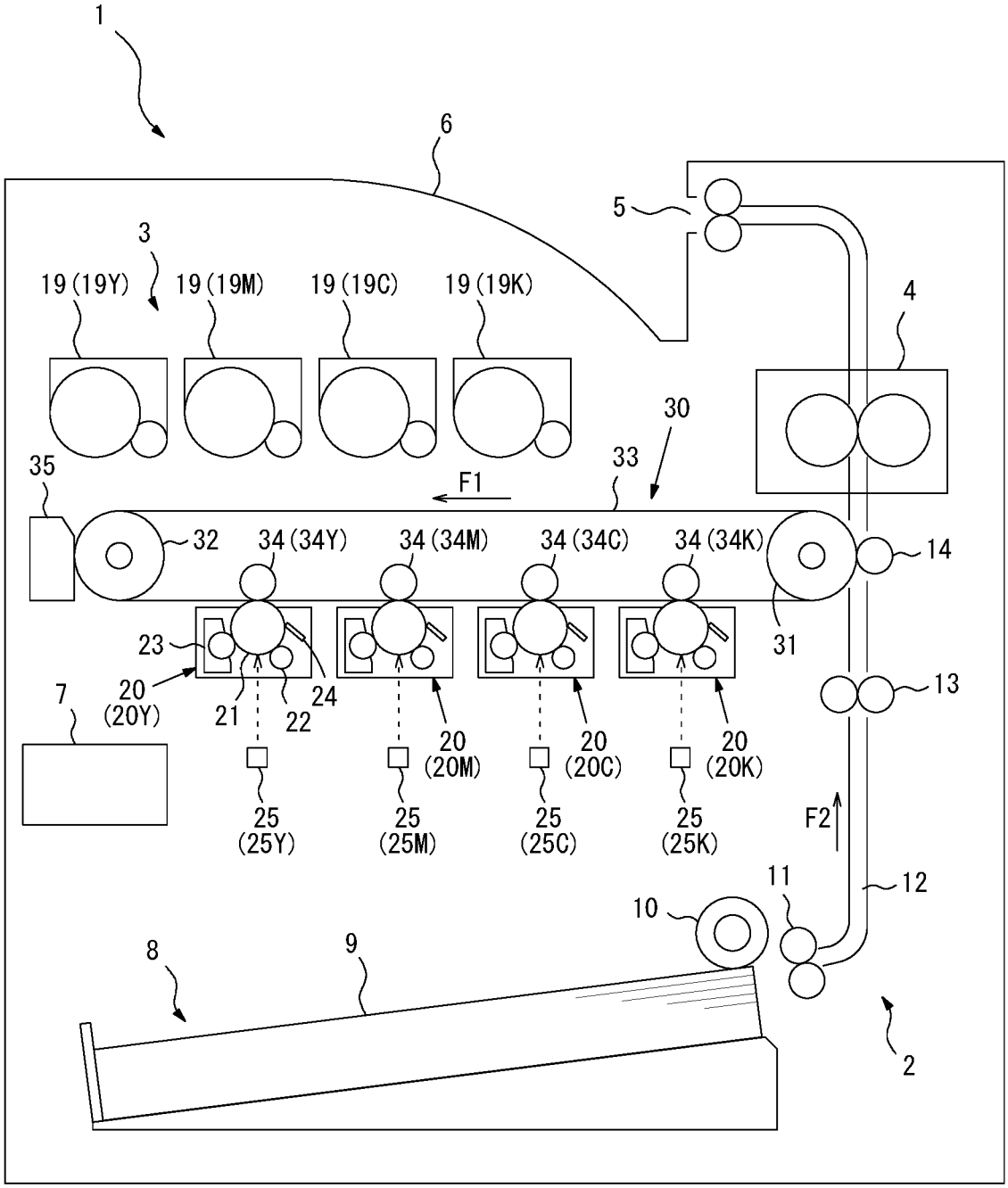
FIG. 1 illustrates an exemplary structure of an image forming device.

FIG. 1 illustrates an exemplary structure of an image forming device 1 in which the present embodiment of the present invention may be practiced. The image forming device 1 of FIG. 1 is a device that processes a print job specified by a user and produces a printed output. To be more specific, the image forming device 1 is a printer that forms an image on a sheet 9 such as a printing sheet in electrophotography and outputs. The image forming device 1 is capable of forming a color image in tandem system. The image forming device 1 includes a feeding unit 2, an image forming unit 3 and a fixing unit 4 inside the device body. The image forming device 1 delivers the sheet 9 stored in a sheet feeding cassette 8 one by one. The sheet feeding cassette 8 is provided in a lower part of the device body. The image forming device 1 forms a color image or a black and white image on the sheet 9, and delivers the sheet 9 on a sheet delivery tray 6 from a sheet delivery port 5 provided in an upper part of the device body. The image forming device 1 includes a controller 7 inside the device body. The controller 7 controls operations of each part such as the feeding unit 2, the image forming unit 3 and the fixing unit 4.

The feeding unit 2 includes the sheet feeding cassette 8, a pick-up roller 10, a sheet feeding unit 11, a carrying path 12, a resisting unit 13 and a secondary transfer unit 14. The sheet feeding cassette 8 is a container in which a bundle of sheet type sheets 9 are stored. The pick-up roller 10 takes the sheet 9 from a top of the bundle of the sheets 9 stored in the sheet feeding cassette 8, and feeds out toward the sheet feeding unit 11. The sheet feeding unit 11 picks up the single sheet 9 on the top of one or more than one sheet 9 fed by the pick-up roller 10.

The carrying path 12 is a path to carry the sheet 9 toward an arrow F2 direction. The resisting unit 13 corrects the skew of the sheet 9 carried along the carrying path 12 by the sheet feeding unit 11. The resisting unit 13 includes a pair of timing rollers, for example. The resisting unit 13 corrects the skew of the sheet 9 at the upstream side from the pair of timing rollers. The resisting roller 15 then holds the leading end of the sheet 9 with a nip part of the pair of timing rollers. When the leading end of the sheet 9 is hold with the nip part of the pair of timing rollers, the feeding unit 2 temporarily stops carrying the sheet 9. The resisting unit 13 drives the pair of timing rollers in accordance with a timing that a toner image formed by the image forming unit 3 moves to a position of the secondary transfer unit 14, and carries the sheet 9 to the position of the secondary transfer unit 14. The toner image is transferred to a surface of the sheet 9 when the sheet 9 passes through the nip position of the secondary transfer unit 14. The toner image transferred on the surface of the sheet is then fixed to the sheet 9 when the sheet 9 passes through the fixing unit 4. The fixing unit 4 performs a heating operation and a pressure operation on the carried sheet 9 so that the toner image is fixed to the sheet 9. The sheet 9 is then delivered on the paper delivery tray 6 from the delivery port 5.

The image forming unit 3 forms toner images of four colors, Y (yellow), M (magenta), C (cyan) and K (black), and transfers the toner images of the four colors at the same time to the sheet 9 passing through the position of the secondary transfer unit 14. The image forming unit 3 includes multiple toner bottles 19 (19Y, 19M, 19C and 19K) of the respective colors, multiple image units 20 (20Y, 20M, 20C and 20K) of the respective colors, multiple exposure units 25 (25Y, 25M, 25C and 25K) of the respective colors and a transfer unit 30.

The transfer unit 30 is formed from a pair of rollers 31 and 32 and an endless belt. The pair of rollers 31 and 32 are arranged with a predetermined interval in between. The transfer unit 30 includes an intermediate transfer belt 33, multiple primary transfer rollers 34 (34Y, 34M, 34C and 34K) and a cleaner 35, and they are integrally assembled. The intermediate transfer belt 33 is crossed between the pair of rollers 31 and 32. The multiple primary transfer rollers 34 are arranged at positions facing the respective image units 20 inside the intermediate transfer belt 33. The cleaner 35 is to remove a toner remaining on a surface of the intermediate transfer belt 33.

The roller 31 which is one of the pair of rollers 31 and 32 is a driving roller which is attached to a driving shaft arranged inner side of the device body and rotates. The rotation of the driving shaft enables a circulating movement of the intermediate transfer belt 33 in an arrow F1 direction. Another roller 32 is attached to a driven shaft arranged inside the device body. Another roller 32 rotates by the circulating movement of the intermediate transfer belt 33. The pair of rollers 31 and 32 apply certain tension to the intermediate transfer belt 33 and they are arranged at positions separated from each other for a predetermined interval inside the device body. The roller 31 is attached to a driving shaft inside the device body so that it is arranged at a position facing the secondary transfer unit 14. The roller 31 sandwiches the intermediate transfer belt 33 between itself and the secondary transfer unit 14, and applies a pressing force to the intermediate transfer belt 33. The roller 31 sandwiches and presses the sheet fed from the resisting unit 13 between the intermediate transfer belt 33 and the secondary transfer unit 14 so that the toner image formed on the surface of the intermediate transfer belt 33 is secondarily transferred to the sheet 9.

The cleaner 35 is kept in a state that is in contact with the surface of the intermediate transfer belt 33 at a position that faces the roller 32. The cleaner 35 removes a toner remaining on the surface of the intermediate transfer belt 33 that circularly moves in the arrow F1 direction. The cleaner 35, for instance, includes a cleaning blade or a cleaning brush. The cleaner 35 enables the cleaning blade or the cleaning brush to be in contact with the surface of the intermediate transfer belt 33.

The image units 20Y, 20M, 20C and 20K corresponding to the respective colors are provided in a lower position of the transfer unit 30. The exposure units 25Y, 25M, 25C and 25K corresponding to the respective colors are arranged in a further lower position of each of the image units 20Y, 20M, 20C and 20K. The toner bottles 19Y, 19M, 19C and 19K are provided in an upper position of the transfer unit 30 to supply the toner of each color to the respective image units 20Y, 20M, 20C and 20K.

Each image unit 20Y, 20M, 20C and 20K has the same structure but uses the different color of toner. To be more specific, each image unit 20Y, 20M, 20C and 20K includes an image carrier 21 formed as a photoreceptor drum, an electrifying unit 22 arranged around the image carrier 21, a developing unit 23 and a cleaning blade 24, and they are integrally assembled. If differentiation between each image unit 20Y, 20M, 20C and 20K is not necessary, the image units 20Y, 20M, 20C and 20K may be called as the image unit 20.

The image carrier 21 has a photosensitive layer on a drum surface. The image carrier 21, for instance, is in contact with the intermediate transfer belt 33 to which a transferring force by the primary transfer roller 34 of the transfer unit 30 is applied, and rotates in a clockwise direction. Along the rotation direction, the cleaning blade 24, the electrifying unit 22 and the developing unit 23 are arranged around the image carrier 21. The electrifying unit 22 includes an electrifying roller that is in contact with the surface of the image carrier 21, and charges the surface of the image carrier 21 at a predetermined charge amount. The exposure unit 25 exposures the photosensitive layer charged by the electrifying unit 22 based on the image data to form a latent image on the surface of the image carrier 21. The developing unit 23 stores the toner supplied from the toner bottle 19. The carrier and the toner are stirred and the toner is charged. The charged toner is supplied to the surface of the image carrier 21 and the latent image is enabled to be visible with the toner. The toner image is then formed on the surface of the image carrier 21. The toner image formed on the image carrier 21 is primarily transferred to the intermediate transfer belt 33 at a position which is in contact with the intermediate transfer belt 33. A bias voltage which is a reverse polarity from the charged toner image formed on the surface of the image carrier is applied to the primary transfer roller 34. The primary transfer roller 34 is enabled to primarily transfer the toner image formed on the surface of the image carrier to the intermediate transfer belt 33 by an electrostatic power.

Each image unit 20Y, 20M, 20C and 20K works together with the corresponding primary transfer roller 34Y, 34M, 34C and 34K to superpose the toner image of each color one after another on the intermediate transfer belt 33 which is circulated and moved in the arrow direction F1 and enable primary transfer. When the intermediate transfer belt 33 passes through the position of the image unit 20K which is at downstream end, a color image which is superposing the toner images of four colors is formed on the surface of the intermediate transfer belt 33. In order to form a black and white image on the sheet 9, the image units 20Y, 20M and 20C are not brought into operation. Only the image unit 20K corresponding to K (black) becomes operative to form the black and white image on the intermediate transfer belt 33 with the toner of K.

The toner image formed on the intermediate transfer belt 33 is in contact with the sheet 9 carried by the feeding unit 2 and secondarily transferred on the surface of the sheet 9 when passing through a position facing the secondary transfer unit 14. To be more specific, the secondary transfer unit 14 is arranged at a position facing the roller 31 across the intermediate transfer belt 33. The secondary transfer unit 14 applies the bias voltage which is a reverse polarity from the charged toner when the toner image primarily transferred to the intermediate transfer belt 33 is in contact with the sheet 9 so that the toner image is secondarily transferred to the sheet 9.

Even after the secondary transfer of the toner image to the sheet 9 at the secondary transfer unit 14, some of the toner may remain on the surface of the intermediate transfer belt 33. The remaining toner is attached to the surface of the intermediate transfer belt 33 and is circularly moved together with the intermediate transfer belt 33. When the intermediate transfer belt 33 passes through the cleaner 35, the remaining toner is removed from the surface of the intermediate transfer belt 33 by the cleaning blade or the cleaning brush provided with the cleaner 35.

Even after the toner image formed on the image carrier 21 is primarily transferred to the intermediate transfer belt 33 in each image unit 20Y, 20M, 20C and 20K, the toner may remain on the surface of the image carrier 21. The remaining toner proceeds toward the cleaning blade 24 in accordance with the rotation of the image carrier 21, and removed from the surface of the image carrier 21 by the cleaning blade 24.

Figure 2:
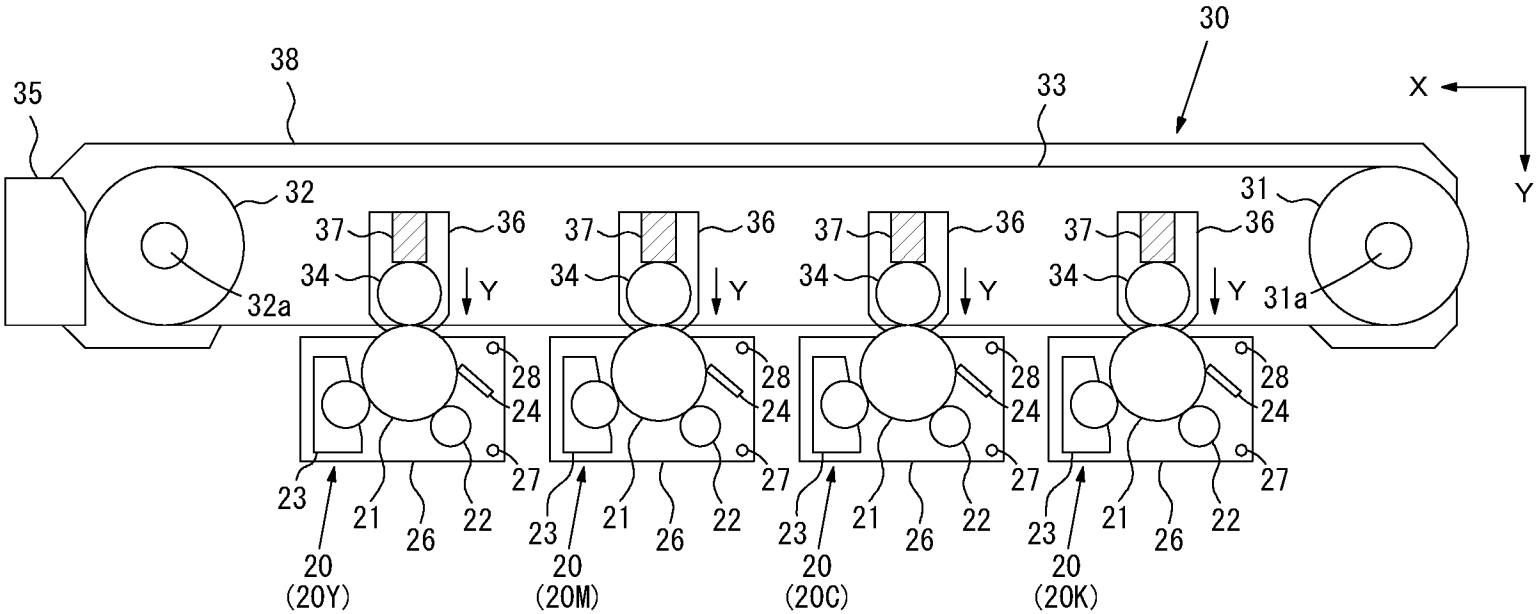
FIG. 2 illustrates an example of an enlarged transfer unit and each image unit.

FIG. 2 illustrates an example of the enlarged transfer unit 30 and each image unit 20Y, 20M, 20C and 20K. As illustrated in FIG. 2, the transfer unit 30 includes a unit body 38. The unit body 38 is provided with the pair of rollers 31 and 32, the intermediate transfer belt 33, the primary transfer roller 34, and the cleaner 35. Each of the parts are attachable to and removable from the device body. To be more specific, the transfer unit 30 is a replaceable part of the image forming device 1. Once the lifetime of the part such as the intermediate transfer belt 33 ends, the part is removed and replaced to a new one. The transfer unit 30 is attached to be adjacent to the upper side of each image unit 20.

The unit body 38 has a rotation shaft attachment 31*a* of the roller 31 attached to the rotation shaft of the device body and a driven shaft attachment 32*a* of the roller 32 attached to the driven shaft of the device body. The unit body 38 is therefore attached to the device body. The rotation shaft of the device body works as a positioning member (a second positioning member) to position the transfer unit 30. Each of the primary transfer rollers 34 is hold by a holding member 36 arranged inside the unit body 38. The holding member 36 holds the primary transfer roller 34 and an energizing member 37. The energizing member 37 energizes the primary transfer roller 34 toward a direction (Y direction) in which each image unit 20 is positioned. The energizing member 37 includes an elastic member such as a spring.

Each unit body 38 has variations in positions where each primary transfer roller 34 is hold. When, for example, the center of the rotation shaft attachment 31*a* is considered as a reference position, each unit body 38 has variations in the center of each primary transfer roller 34 in each X and Y directions. There are individual differences in each primary transfer roller 34 so that there are variations in an outer diameter of each primary transfer roller 34. Once the transfer unit 30 attached to the image forming device 1 is replaced, the position to put a pressure loaded on the intermediate transfer belt 33 and an amount of the pressure loaded on the intermediate transfer belt 33 by the primary transfer roller 34 vary.

Each image unit 20 also includes a unit body 26. The unit body 26 is provided with the above-described image carrier 21, cleaning blade 24, electrifying unit 22 and developing unit 23. Each of the parts are attachable to and removable from the device body. To be more specific, each image unit 20 is a replaceable part of the image forming device 1. Once the lifetime of the photosensitive layer of the surface of the image carrier 21 ends, the image unit 20 is removed and replaced to a new one.

Multiple fitting units 27 and 28 arranged at predetermined positions, for example, are attached to the device body so that the unit body 26 is attached to the device body. There are multiple fitted units to which the fitting units 27 and 28 are attached in the device body. The fitted unit to which the fitting unit 27 is attached works as a positioning member (a first positioning member) to position the image unit 20. Hence, the image carrier 21 is positioned and arranged in the lower position of the transfer unit 30.

Each unit body 26 has variations in positions where each image carrier 21 is hold. When, for example, the attached position of the fitting unit 27 is considered as a reference position, each unit body 26 has variations in the center of the image carrier 21 in each X and Y directions. There are individual differences in each image carrier 21 so that there are variations in an outer diameter of each image carrier 21. Once the image unit 20 attached to the image forming device 1 is replaced, a relation between the positions of the image carrier 21 and the primary transfer roller 34 changes. A transfer pressure applied to the image carrier 21 by the primary transfer roller 34 then varies.

For processing a print job, the image forming device 1 produces a certain difference in speed between a speed when the intermediate transfer belt 33 moves in the arrow F1 direction and a speed of the rotation of the image carrier 21. The produced difference in speed enables to enhance the transfer efficiency of the toner image from the image carrier 21 to the intermediate transfer belt 33. The difference in speed produces a friction corresponding to the transfer pressure applied from the primary transfer roller 34 to the photosensitive layer of the image carrier 21. The photosensitive layer is gradually worn out due to the produced friction. The wear level of the photosensitive layer varies depending on a change in the transfer pressure applied from the primary transfer roller 34. To be more specific, the life of the image carrier 21 changes depending on the transfer unit 30 and the image unit 20 attached to the image forming device 1.

The cleaning blade 24 provided with the image unit 20 is also in contact with the surface of the image carrier 21. The position of the cleaning blade 24 in contact with the image carrier 21 and a contact pressure of a tip of the cleaning blade 24 applied to the surface of the image carrier 21 are adjustable in production of the image unit 20. The individual difference between each image unit 20 may be eliminated in advance. The only cause that affects the end of the life of the image carrier 21 is the transfer pressure applied to the image carrier 21 from the primary transfer roller 34 as described above.

Figure 3:
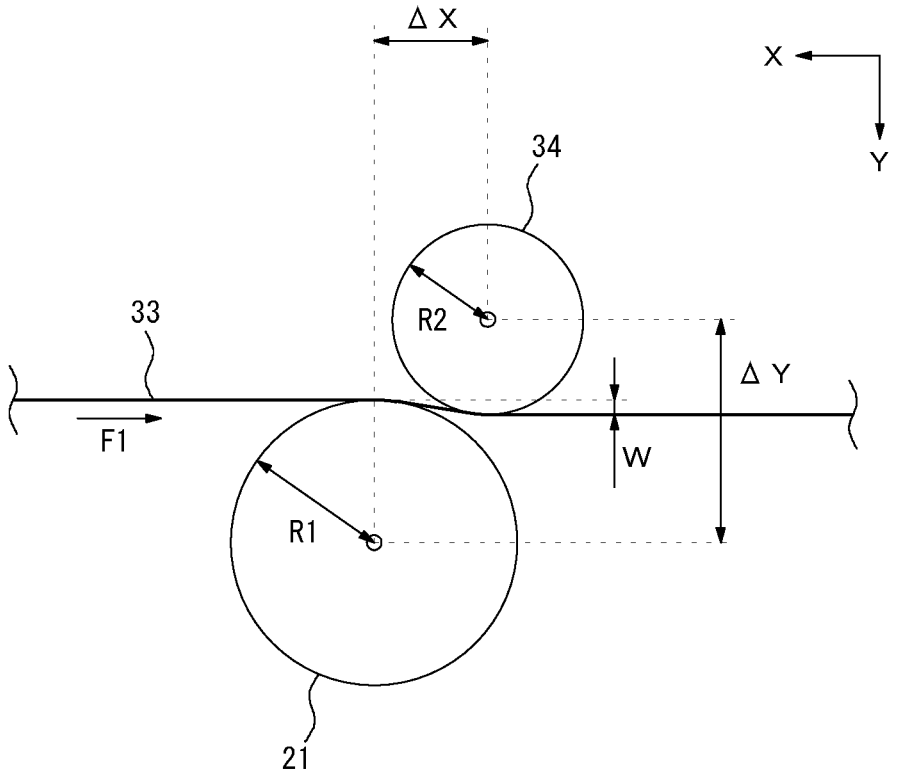
FIG. 3 illustrates a relative positional relation between a primary transfer roller and an image carrier.

FIG. 3 illustrates a relative positional relation between the primary transfer roller 34 and the image carrier 21. As described above, there are variations in the position and the outer diameter of the primary transfer roller 34 in the transfer unit 30. There are also variations in the position and the outer diameter of the image carrier 21 in the image unit 20. The relative positional relation between the primary transfer roller 34 and the image carrier 21 varies depending on the individual difference of each transfer unit 30 and the image unit 20 attached to the image forming device 1. To be more specific, a distance between the shafts □X in X direction and a time distance □Y in Y direction of the primary transfer roller 34 and the image carrier 21 vary. There is also an individual difference in the outer diameter of the primary transfer roller 34 and the outer diameter of the image carrier 21. A quantity of depression W produced when the primary transfer roller 34 depresses the intermediate transfer belt 33 in Y direction also varies in accordance with the distance between the shafts □X and □Y.

Figure 4:
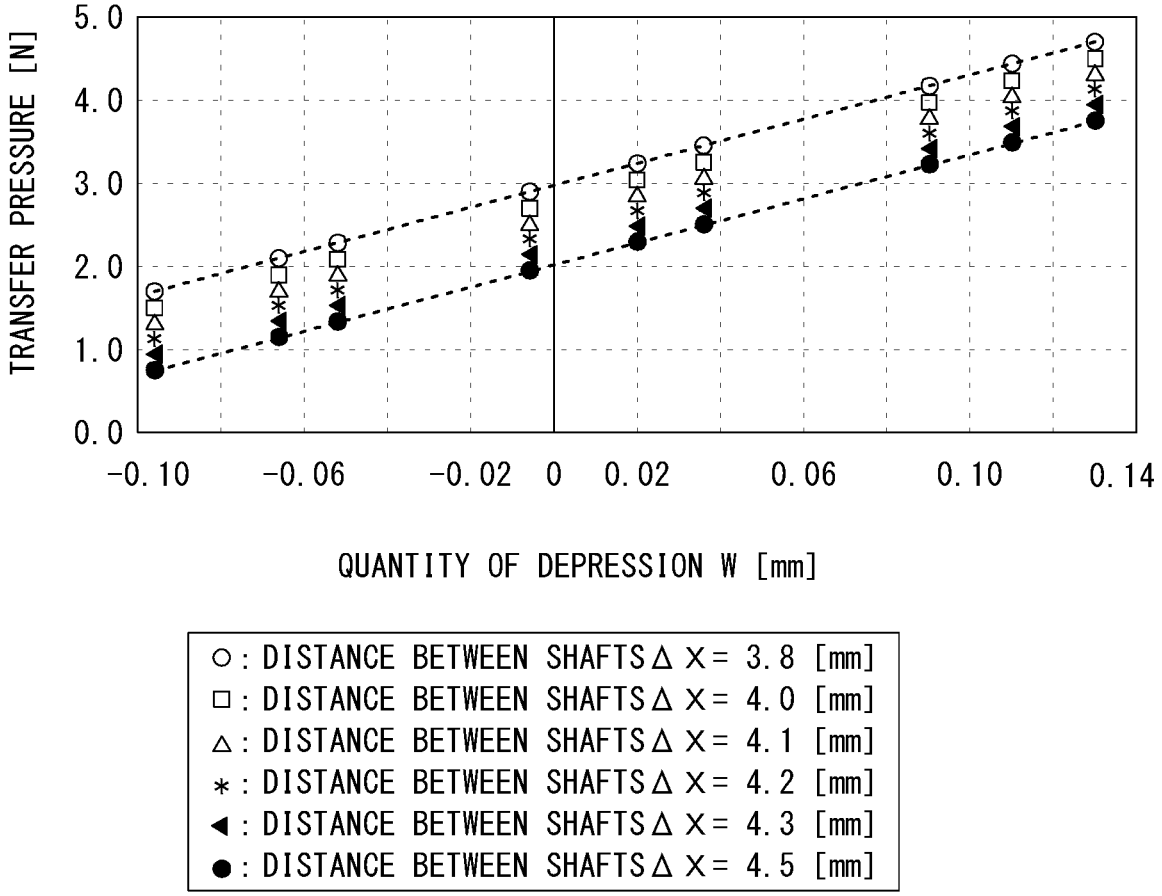
FIG. 4 illustrates a relation between a quantity of depression and a transfer pressure related to multiple distances between shafts.

FIG. 4 illustrates a relation between the quantity of depression W and the transfer pressure by giving an example of multiple distances between the shafts □X. As illustrated in FIG. 4, the larger quantity of depression W the primary transfer roller 34 produces, the higher transfer pressure. The longer distance between the shafts □X, the lower transfer pressure. In contrast, the shorter distance between the shafts □X, the higher transfer pressure. By using the relation of FIG. 4, the relative positional relation between the primary transfer roller 34 and the image carrier 21 can be figured out at the attachment of the new image unit 20 to the image forming device 1, for example. Once the relative positional relation between the primary transfer roller 34 and the image carrier 21 can be figured out, an initial value of the transfer pressure applied to the image carrier 21 may be specified. If the initial value of the transfer pressure applied to the image carrier 21 may be specified, a degree of wear in the image carrier 21 due to the processing of the print job may be predicted in advance.

Figure 5:
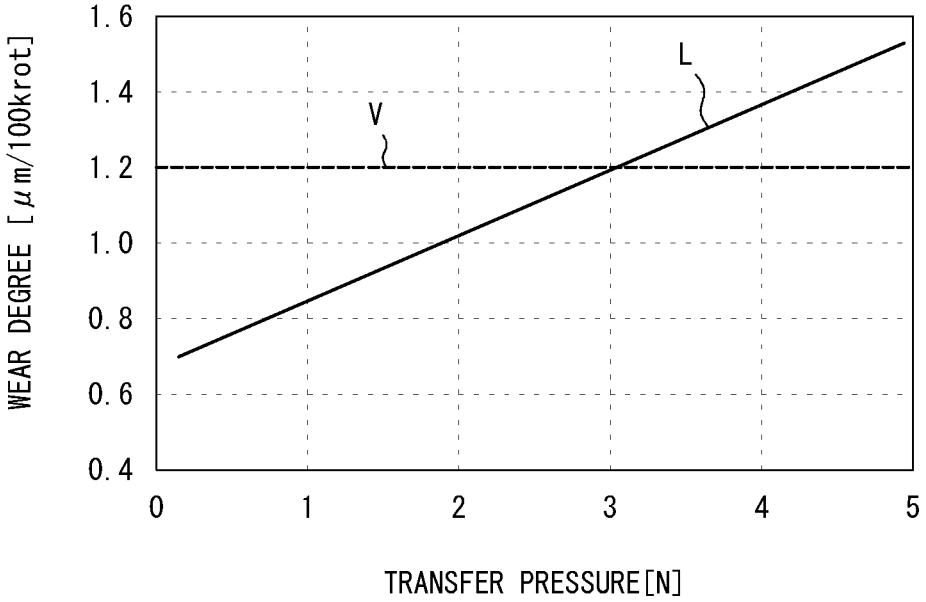
FIG. 5 illustrates an example of a relation between an initial value of the transfer pressure and a wear degree in the image carrier.

FIG. 5 illustrates an example of a relation between the initial value of the transfer pressure and the wear degree in the image carrier 21. It is assumed, for example, the initial value of the transfer pressure is 2[N]. In this case, the wear degree in the image carrier 21 after the 100 k rotations is 1.02 [μm]. It is assumed, for example, the initial value of the transfer pressure is 4[N]. In this case, the wear degree in the image carrier 21 after the 100 k rotations is 1.37 [μm]. It is further assumed, for example, it is a target on design to replace the image unit 20 when the wear degree in the image carrier 21 after 100 k rotations reaches 1.02[μm]. More specifically, as a guide for determining the replacement time of the image unit 20, a reference value V=1.02 [μm] is set, for instance. In this case, if the initial value of the transfer pressure is 2[N] as described above, the wear degree after 100K rotations is 1.02 [μm]. This is only 85% of wear degree to the reference value V. There still is a margin of 15%. The life of the image unit 20 when the initial value of the transfer pressure is 2[N] is 118% to the default value (100 k rotations). This means the number of rotations can be extended to 118 k rotations. If the initial value of the transfer pressure is 4[N] as described above, the wear degree after 100K rotations is 1.37 [μm]. This is 106% of wear degree to the reference value V after the 100 k rotations. This means the life has already been ended. The life of the image unit 20 when the initial value of the transfer pressure is 4[N] is 88% to the default value (100 k rotations). The number of the rotations is required to be reduced to 88 k rotations.

Figure 6:
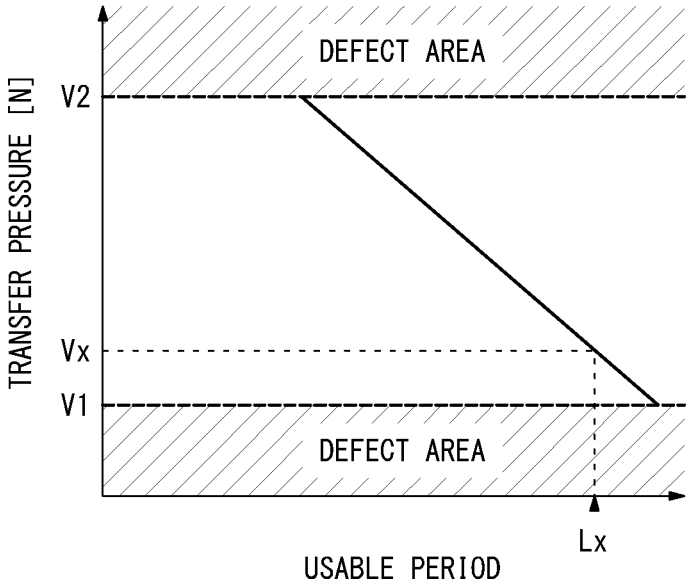
FIG. 6 illustrates a relation between the initial value of the transfer pressure and a usable period.

As described above, once the initial value of the transfer pressure is found out, the life of the image unit 20 may be specified. The image forming device 1, therefore, is enabled to appropriately set a usable period of the image unit 20 when the image unit 20 is attached. FIG. 6 illustrates a relation between the initial value of the transfer pressure and the usable period. When the initial value of the transfer pressure is less than a predetermined value V1, the toner image cannot be properly transferred to the intermediate transfer belt 33 from the image carrier 21. Also, when the initial value of the transfer pressure is equal to or more than a predetermined value V2 (though V2>V1), the toner image cannot be properly transferred to the intermediate transfer belt 33 from the image carrier 21. As illustrated in FIG. 6, when the initial value of the transfer pressure is less than the predetermined value V1 or equal to or more than the predetermined value V2, the transfer pressure is determined to be defect. A warning is issued at the attachment of the image unit 20.

On the other hand, when the initial value of the transfer pressure is equal to or more than the predetermined value V1 and less than the predetermined value V2, the toner image can be properly transferred to the intermediate transfer belt 33 from the image carrier 21. In this case, the image forming device 1 sets the usable period of the image unit 20 corresponding to the initial value of the transfer pressure. If the initial value of the transfer pressure is Vx, for example, a usable period Lx which corresponds to Vx is set. The controller 7 mainly processes the process to set the appropriate usable period for each image unit 20. The detailed structure and operation of the controller 7 is described next.

Figure 7:
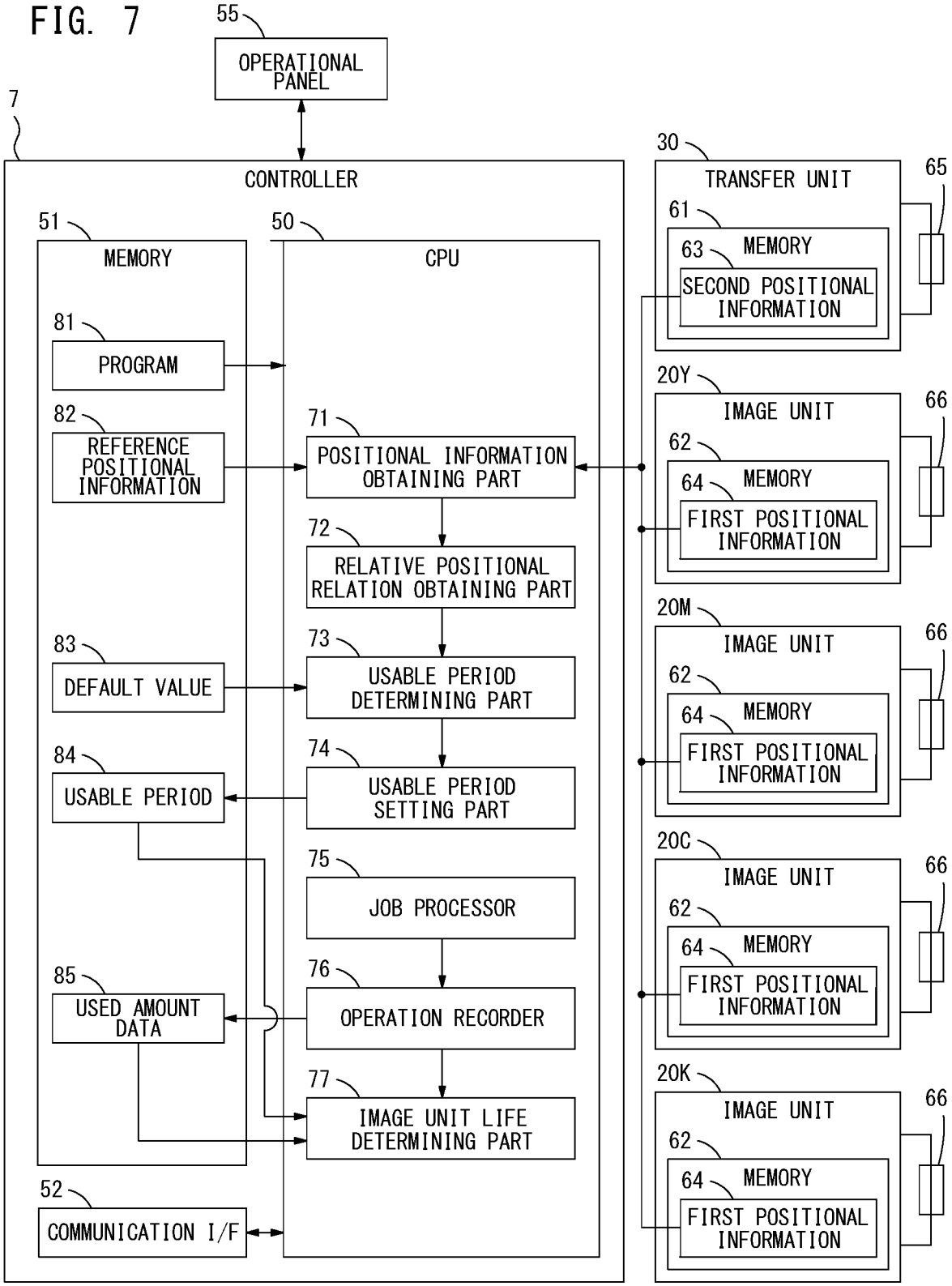
FIG. 7 illustrates a block diagram showing an example of a structure of a controller.

FIG. 7 illustrates a block diagram showing an example of a structure of the controller 7. As illustrated in FIG. 7, the aforementioned transfer unit 30 and each image unit 20 are connected to the controller 7. An operational panel 55 is also connected to the controller 7. The operational panel 55 is a user interface for a user to use the image forming device 1. The operational panel 55 includes a display unit, a manipulation unit and a speaker. The display unit is constructed by a device such as a liquid crystal display, for instance. The manipulation unit is constructed by a part such as a touch panel sensor. The speaker outputs a sound such as a warning sound.

The controller 7 includes a CPU 50, a memory 51 and a communication interface 52. The CPU 50 is an arithmetic processor that reads and executes a program 81 stored in the memory 51. The memory 51 is a storage in which the program 81 and/or a variety of information is stored. The communication interface 52 connects the image forming device 1 to a network such as LAN (Local Area Network). The communication interface 52 enables the image forming device 1 to communicate with an external device such as a personal computer and/or a server connected to the network.

The CPU 50 reads and executes the program 81 to serve as a positional information obtaining part 71, a relative positional relation obtaining part 72, a usable period determining part 73, a usable period setting part 74, a job processor 75, an operation recorder 76 and an image unit life determining part 77. The CPU 50 brings each part into operation to set the appropriate usable period for each image unit 20 corresponding to the transfer pressure applied by the primary transfer roller 34 to the image carrier 21 and to manage the appropriate replacement time.

Reference positional information 82, a default value 83 of the usable period of the image unit 20, a usable period 84 set for each image unit 20 and used amount data 85 of each image unit 20 are stored besides the aforementioned program 81 in the memory 51. Information showing a reference position for attaching each of the transfer unit 30 and the image unit 20 to the device body is stored as the reference positional information 82. There are variations in the position of the rotation shaft (the second positioning member) to which the roller 31 of the transfer unit 30 is attached and the position of the fitted unit (the first positioning member) to which the fitting unit 27 of each image unit 20 is attached in the device body, for example. The reference positional information 82 includes second reference positional information and first reference positional information. The position of the rotation shaft to which the transfer unit 30 is attached in the device body is stored as the second reference positional information. The position of the fitted unit to be a reference for attaching each image unit 20 is stored as the first reference positional information. The first reference positional information and the second reference positional information are measured in advance when the device body is manufactured, for example. The relative positional relation between the transfer unit 30 and the image unit 20 attached to the device body can be calculated based on the first reference positional information and the second reference positional information. The reference positional information 82 may be information that registers in advance a relative positional relation between the position of the rotation shaft to which the roller 31 is attached and the position of the fitted unit to which the fitting unit 27 of each image unit 20 is attached. The default value 83 of the usable period shows the usable period set as a target value on design. A value such as 100 k rotations is set in advance as the number of rotations of the image carrier 21 as described above, for example. The usable period 84 shows the usable period of each image unit 20 determined by correcting the default value 83. The usable period corresponds to the usable period Lx in FIG. 6, for instance. The used amount data 85 shows the used amount of each image unit 20. Information such as the number of rotations of the image carrier 21 is stored as the used amount data 85, for example.

The positional information obtaining part 71 obtains the positional information required for identifying the relative positional relation between the transfer unit 30 and each image unit 20. A memory 61 is equipped in the transfer unit 30, for example. Once the transfer unit 30 is attached to the device body, the controller 7 is enabled to access the memory 61. The positional information obtaining part 71 accesses the memory 61 of the transfer unit 30 attached to the device body and reads second positional information 63 stored in the memory 61. The second positional information 63 includes information relating to a central position of the primary transfer roller 34 and the outer diameter of the primary transfer roller 34 measured in advance upon manufacturing on a basis of the position to which the roller 31 is attached in the transfer unit 30.

A memory 62 is also equipped in each image unit 20. Once each image unit 20 is attached to the device body, the controller 7 is enabled to access the memory 62. The positional information obtaining part 71 accesses the memory 62 of the image unit 20 attached to the device body and reads first positional information 64 stored in the memory 62. The first positional information 64 includes information relating to a central position of the image carrier 21 and the outer diameter of the image carrier 21 measured in advance upon manufacturing on a basis of the position to which the fitting unit 27 is attached in the image unit 20.

The positional information obtaining part 71 reads the reference positional information 82 in the memory 51. As described above, the positional information obtaining part 71 obtains the various types of positional information. Upon detecting that any of the transfer unit 30 or the image unit 20 is attached to the device body, the positional information obtaining part 71 may obtain the positional information.

More preferably, the positional information obtaining part 71 obtains the positional information when the unused transfer unit 30 or the unused image unit 20 is attached to the device body. By determining if a fuse 65 of the transfer unit 30 or a fuse 66 of the image unit 20 is cut, whether the transfer unit 30 or the image unit 20 attached to the device body is unused can be determined. To be more specific, when the unused transfer unit 30 is attached to the device body and the electricity is passed from the device body, the fuse 65 is cut. When the unused image unit 20 is attached to the device body and the electricity is passed from the device body, the fuse 66 is cut. After detecting that the transfer unit 30 or the image unit 20 is attached to the device body, the positional information obtaining part 71 may detect that the fuse 65 or 66 is cut upon passage of the electricity. In this case, the positional information obtaining part 71 is enabled to specify that the attached transfer unit 30 or image unit 20 is unused. The positional information obtaining part 71 obtains the positional information only if the transfer unit 30 or the image unit 20 attached to the device body is unused. The positional information obtaining part 71 then does not have to process unnecessary processing when the transfer unit 30 or the image unit 20 is just being removed and detached due to an error such as a jam which is not the replacement of the transfer unit 30 or the image unit 20, for example.

The relative positional relation obtaining part 72 obtains a relative positional relation between the image unit 20 and the transfer unit 30 based on the first positional information 64, the second positional information 63 and the reference positional information 82 obtained by the positional information obtaining part 71. More specifically, the relative positional relation obtaining part 72 obtains the relative positional relation between the primary transfer roller 34 and the image carrier 21. To be more specific, the relative positional relation obtaining part 72 identifies the relative positional relation between the image unit 20 and the transfer unit 30 based on the reference positional information 82. The relative positional relation obtaining part 72 then identifies the relative positional relation between the primary transfer roller 34 and the image carrier 21 based on the first positional information 64 and the second positional information 63. As a result, the distance between the shafts □X and the quantity of depression W as described above may be obtained.

The usable period determining part 73 determines the usable period of the image unit 20 attached to the image forming device 1 based on the relative positional relation between the primary transfer roller 34 and the image carrier 21 obtained by the relative positional relation obtaining part 72. The usable period determining part 73, for example, calculates an initial value of the transfer pressure using the relation of FIG. 4 based on the distance between the shafts □X and the quantity of depression W obtained by the relative positional relation obtaining part 72. The usable period determining part 73 then refers to the relation of FIG. 5 based on the initial value of the transfer pressure to correct the default value 83 of the usable period. The usable period determining part 73 determines the usable period of the image unit 20 attached to the image forming device 1. After the calculation of the initial value of the transfer pressure, the usable period determining part 73 may determine the usable period of the image unit 20 attached to the image forming device 1 using the relation of FIG. 6.

The usable period setting part 74 sets the usable period determined by the usable period determining part 73 as the usable period 84 of the image unit 20 attached to the image forming device 1. To be more specific, the usable period setting part 74 stores the usable period 84 determined by the usable period determining part 73 corresponding to the image unit 20 attached to the image forming device 1 in the memory 51, and sets the usable period 84 which reflects the individual difference of the image unit 20.

The job processor 75 controls the processing of the print job in the image forming device 1. When the print job is received via the communication interface 52, for example, the job processor 75 in the CPU 50 becomes operative. The job processor 75 drives the feeding unit 2, the image forming unit 3 and the fixing unit 4 as described above based on the print job to form the image based on the print job on the sheet 9 and output the sheet 9.

When the print job is processed by the job processor 75, the operation recorder 76 updates the used amount data 85 relating to each image unit 20. The operation recorder 76 counts the number of rotations of the image carrier 21 driven during the processing of the print job and adds the counted number of rotations to the number of rotations included in the used amount data 85 to update the used amount data 85.

When the used amount data 85 is updated by the operation recorder 76, the image unit life determining part 77 determines if the life of the image unit 20 has ended. Once the used amount data 85 is updated, the image unit life determining part 77 reads the updated used amount data 85 and the usable period 84 in the memory 51. The image unit life determining part 77 compares the number of rotations of the image carrier 21 stored as the used amount data 85 with the number of rotations specified as the usable period 84. It is assumed, for example, the number of rotations of the image carrier 21 exceeds the number of rotations specified as the usable period 84. In this case, the image unit life determining part 77 determines arrival of the replacement time of the image unit 20. The image unit life determining part 77 notifies the user of the necessity of the replacement of the image unit 20 through the operational panel 55. The image unit life determining part 77 may display a warning screen on the display unit of the operational panel 55 or output a warning sound from a speaker. The image unit life determining part 77 may notify the external device via the communication interface 52 of the arrival of the replacement time of the image unit 20.

When the number of rotations of the image unit 21 does not reach the number of the rotations determined as the usable period 84, the image unit life determining part 77 determines if a predetermined condition is satisfied. The image unit life determining part 77 determines if the remaining number of the rotations of the image carrier 21 to the replacement time of the image unit 20 is less than the predetermined number of rotations, for example. In response to determining that the predetermined condition is satisfied, the image unit life determining part 77 informs the user that the replacement time of the image unit 20 is arriving through the operational panel 55. The image unit life determining part 77 may notify the external device that the replacement time of the image unit 20 is arriving via the communication interface 52.

Figure 8:
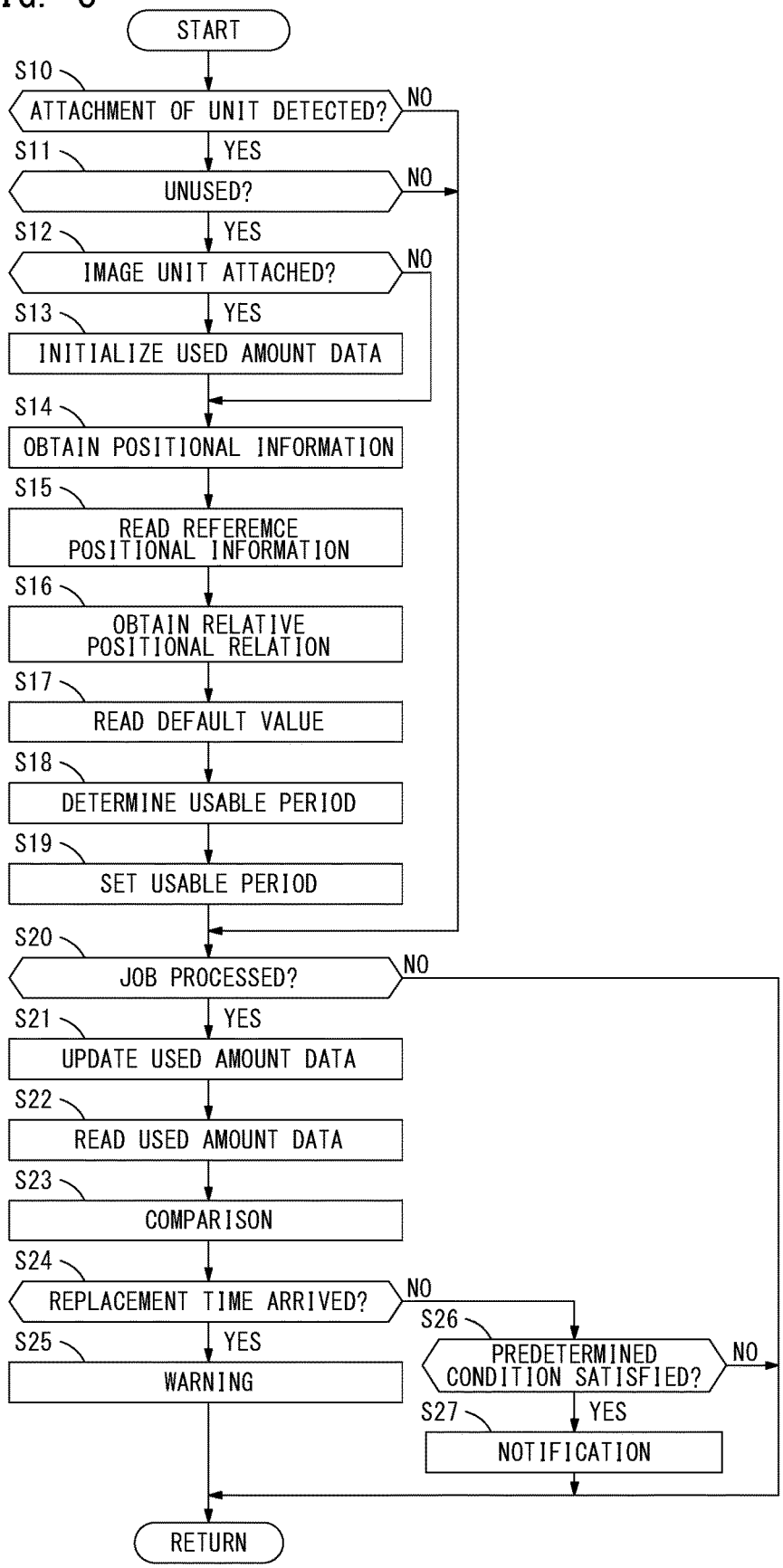
FIG. 8 illustrates a flow diagram explaining an exemplary procedure of the process performed by the controller.

A detailed process sequence performed in the controller 7 is explained next. FIG. 8 illustrates a flow diagram explaining an exemplary procedure of the process performed by the controller 7. This process is performed when the CPU 50 of the controller 7 executes the program 81. The process is repeatedly performed by the controller 7. Upon start of the process, the controller 7 determines if an attachment of the transfer unit 30 or the image unit 20 to the device body is detected (step S10). If the attachment of the transfer unit 30 or the image unit 20 is not detected (when a result of step S20 is NO), the process by the controller 7 proceeds to step S20.

The attachment of the transfer unit 30 or the image unit 20 may be detected (when a result of step S10 is YES). In this case, the controller 7 determines if the attached unit is unused (step S11). When the electricity is supplied to the unit after the attachment of the unit, the controller 7, for instance, determines if the fuse 65 or 66 is cut so that it may identify if the unit is unused. The unit attached to the device body may not be unused and have already been in use (when a result of step S11 is NO). In this case, the process by the controller 7 proceeds to step S20.

When the unit attached to the device body is unused (when a result of step S11 is YES), the controller 7 determines if the attached unit is the image unit 20 (step S12). If the unused image unit 20 is attached (when a result of step S12 is YES), the controller 7 initializes the used amount data 85 corresponding to the image unit 20 (step S13). Thus, the number of rotations of the image carrier 21 thereby accumulated is reset to 0. If the unit attached to the device body is not the image unit 20 and is the transfer unit 30, the process in step S13 is skipped.

The controller 7 obtains the first positional information 64 relating to the image unit 20 and the second positional information 63 relating to the transfer unit 30 (step S14), and reads the reference positional information 82 in the memory 51 (step S15). The controller 7 obtains the relative positional relation between the primary transfer roller 34 and the image carrier 21 based on the positional information obtained in steps S14 and S15 (step S16). Upon obtaining the relative positional relation, the controller 7 reads the default value 83 of a trial period in the memory 51 (step S17). The controller 7 then corrects the default value 83 based on the relative positional relation between the primary transfer roller 34 and the image carrier 21 so that it may determine the usable period 84 of the image carrier (step S18). The controller 7 sets the determined usable period 84 (step S19). As a result, upon the attachment of the unused image unit 20 to the image forming device 1, the usable period 84 appropriate for the image unit 20 is set.

Only the transfer unit 30 may be replaced without the replacement of the image unit 20. In such a case, the controller 7 processes a different procedure from the one described above for setting the usable period of the image unit 20 in step S18. Once the unused transfer unit 30 is attached, the controller 7, for example, may obtain the transfer pressure based on the relative positional relation between the primary transfer roller 34 and the image carrier 21, and correct the usable period 84 that has already been set based on the transfer pressure. To be more specific, the controller 7 corrects the usable period 84 of the image unit 20 after the replacement of the transfer unit 30 based on the position of the transfer unit 30 newly attached. As described above, even when only the transfer unit 30 is replaced, the usable period 84 of the image unit 20 may be managed appropriately.

The controller 7 determines if the print job is processed (step S20). The print job may not be processed (when a result of step S20 is NO). In this case, the process by the controller 7 completes. When the print job is processed (when a result of step S20 is YES), the controller 7 updates the used amount data 85 (step S21). The controller 7 reads the updated used amount data 85 (step S22), and compares the used amount data 85 with the usable period 84 (step S23). Based on a result of the comparison between the used amount data 85 and the usable period 84, the controller 7 determines if the replacement time of the image unit 20 has arrived (step S24). When the replacement time of the image unit 20 has arrived (when a result of step S24 is YES), the controller 7 performs a warning process to ask the user for replacement of the image unit 20 (step S25). If the replacement time of the image unit 20 has not arrived (when a result of step S24 is NO), the controller 7 determines if the predetermined condition is satisfied (step S26). It is assumed, for example, the remaining number of rotations of the image carrier 21 until the replacement time of the image unit 20 is less than the predetermined number of rotations. In this case, the controller 7 determines the predetermined condition is satisfied. Other than this condition, the predetermined condition may be set as required and multiple conditions may be set in advance as the predetermined condition. The predetermined condition may not be satisfied (when a result of step S26 is NO). In this case, the process by the controller 7 completes. If the predetermined condition is satisfied (when a result of step S26 is YES), the controller 7 performs a notification to inform the used of the arrival of the replacement time of the image unit 20 (step S27). As a result, the process performed by the controller 7 completes.

By performing the above-described process, the controller 7 is enabled to set the appropriate usable period for the image unit 20 at attachment of the unused image unit 20 to the device body. To be more specific, the controller 7 is enabled to set in advance the usable period which reflects the individual difference of the image unit 20 as the usable period of the individual image unit 20. This enables the correct determination of the life of the image unit 20. As a result, the image unit 20 can be used until the life of the image carrier 21 ends so that the consuming cost of the image forming device 1 can also be reduced.

As described above, the transfer unit 30 is provided with the memory 61 and the image unit 20 is provided with the memory 62. The second positional information 63 relating to the transfer unit 30 is stored in advance in the memory 61, and the first positional information 64 relating to the image unit 20 is stored in advance in the memory 62. The transfer unit 30 and the image unit 20 may not be provided with the respective memories 61 and 62. In such a case, the first positional information 64 relating to the image unit 20 and the second positional information 63 relating to the transfer unit 30 may be stored in a server installed on a cloud such as internet. For obtaining the first positional information 64 and the second positional information 63, the positional information obtaining part 71 may send a serial number of each transfer unit 30 and image unit 20 attached to the image forming device 1 to the server and obtain the first positional information 64 and the second positional information 63 from the server.

Figure 9:
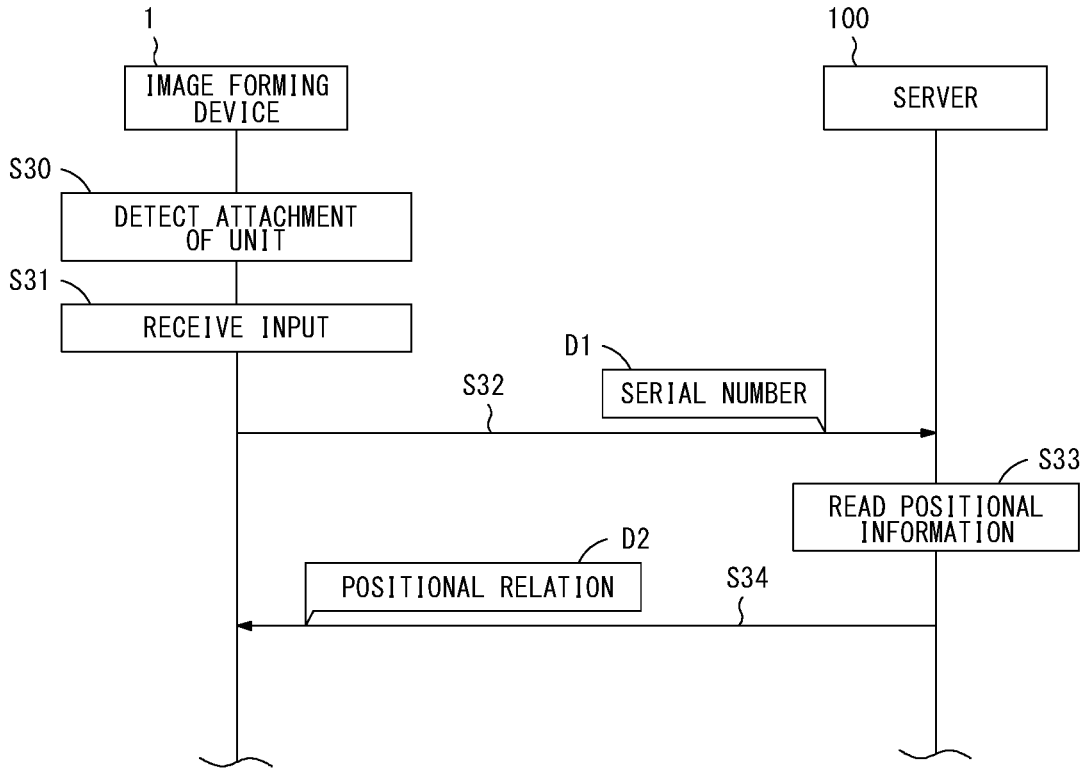
FIG. 9 illustrates a flow diagram explaining an exemplary procedure of the process performed by the image forming device to obtain positional information from a server.

FIG. 9 illustrates a flow diagram explaining an exemplary procedure of the process performed by the image forming device 1 to obtain the positional information from a server 100. When the controller 7 of the image forming device 1 determines the attachment of the transfer unit 30 or the image unit 20 to the device body is detected (step S30), it receives an input of a serial number D1 of the image unit 20 or the transfer unit 30 attached to the device body through the operational panel 55, for example (step S31). Once the serial number D1 is input by the user, the controller 7 sends the serial number D1 to the server 100 via the communication interface 52 (step S52).

The server 100 includes a database in which the serial number and the first positional information 64 or the second positional information 65 corresponding to each other is stored. Upon receiving the serial number D1 from the image forming device 1, the server 100 reads the first positional information 64 or the second positional information 65 corresponding to the serial number D1 in the database (step S33). The server 100 sends positional information D2 including the first positional information 64 or the second positional information 65 to the image forming device 1 (step S34). Upon receiving the positional information D2 from the server 100, the controller 7 of the image forming device 1 stores the first positional information 64 or the second positional information 65 in the positional information D2 as the positional information of the unit attached to the device body.

As described above, the controller 7 may obtain the first positional information 64 related to the image unit 20 or the second positional information 65 related to the transfer unit 30 from the server 100. After the obtaining the second positional information 63 from the server 100, the controller 7 performs the same process as that described above to calculate the relative positional relation between the transfer unit 30 and the image unit 20 and determine the usable period 84 of the image unit 20.

The image forming device 1 may send the serial number of the image unit 20, the serial number of the transfer unit 30 and the reference positional information 82 to the server 100 and enable the server 100 to calculate the relative positional relation between the transfer unit 30 and the image unit 20.

Figure 10:
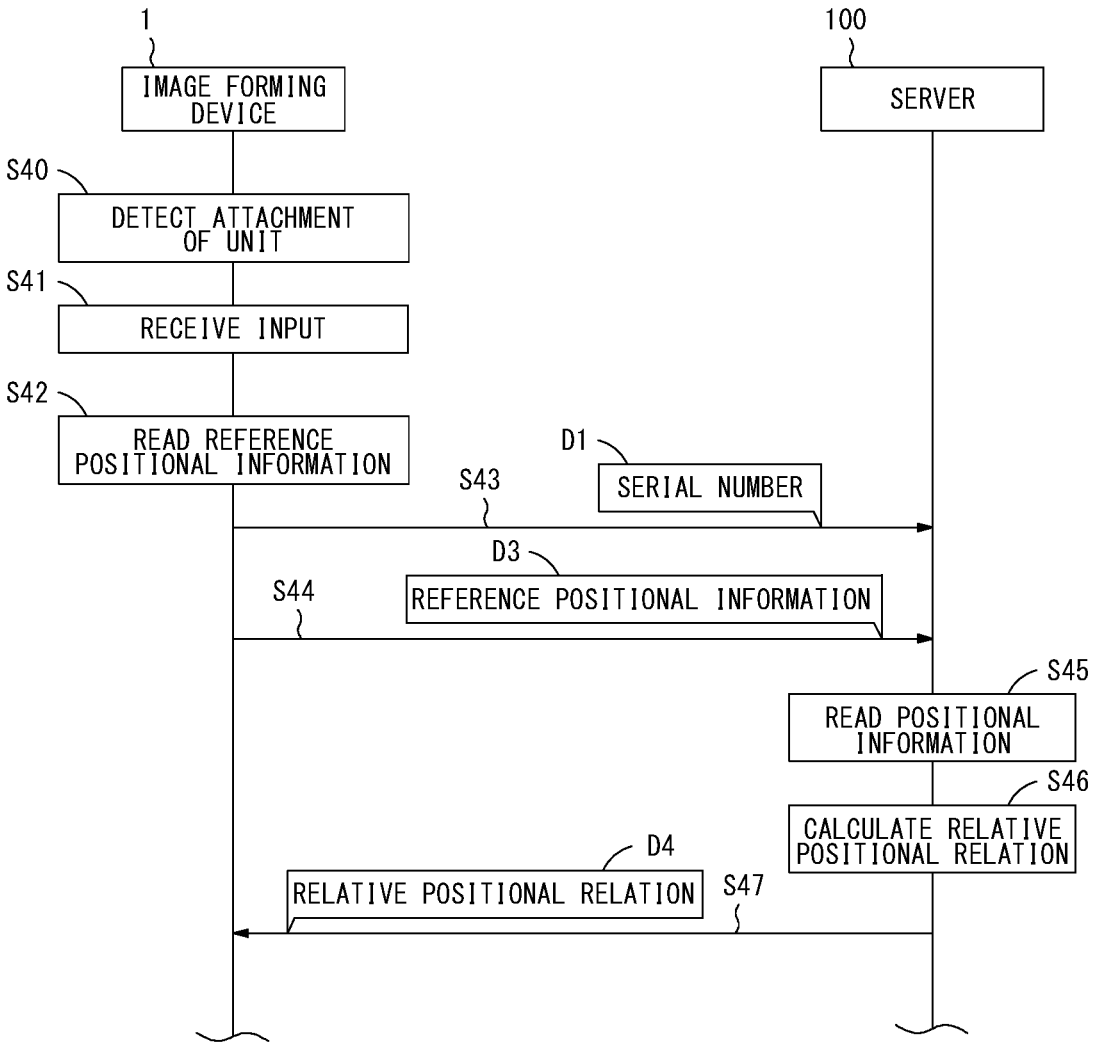
FIG. 10 illustrates a flow diagram explaining an exemplary procedure of the process performed by the image forming device to obtain the relative positional relation from the server.

FIG. 10 illustrates a flow diagram explaining an exemplary procedure of the process performed by the image forming device 1 to obtain the relative positional relation from the server 100. When the controller 7 of the image forming device 1 detects the attachment of the transfer unit 30 or the image unit 20 to the device body (step S40), it receives an input of the serial number of the image unit 20 or the transfer unit 30 attached to the device body through the operational panel 55, for example (step S41). The controller 7 stores the input serial number corresponding to the unit attached to the device body in the memory 51. The controller 7 reads the reference positional information 82 in the memory 51 (step S42). The controller 7 then reads the serial number of the transfer unit 30 and the serial number of the image unit 20 in the memory 51, and sends the serial number D1 including those read serial numbers to the server 100 (step S43). The controller 7 sends the reference positional information 82 read from the memory 51 to the server 100 as the reference positional information D3 (step S44).

Upon receiving the serial number D1 from the image forming device 1, the server 100 reads the second positional information 63 in the database based on the serial number of the transfer unit 30 included in the serial number D1. The server 100 also reads the first positional information 64 in the database based on the serial number of the image unit 20 included in the serial number D1 (step S45). The server 100 then calculates the relative positional relation between the transfer unit 30 and the image unit 20 in the image forming device 1 based on the first positional information 64, the second positional information 63 and the reference positional information D3 (step S46). To be more specific, the server 100 calculates the relative positional relation between the image carrier 21 of the image unit 20 for which the usable period is set and the primary transfer roller 34. The server 100 sends a relative positional relation D4 calculated in step S46 to the image forming device 1 (step S47). Upon receiving the relative positional relation D4 from server 100, the controller 7 of the image forming device 1 stores the relative positional relation D4 in the memory 51.

As described above, the controller 7 may obtain the relative positional relation D4 between the image unit 20 for which the usable period is set and the transfer unit 30 from the server 100. After the controller 7 obtains the relative positional relation D4 from the server 100, it performs the same process as the same as that described above to determine the usable period 84 of the image unit 20.

Figure 11:
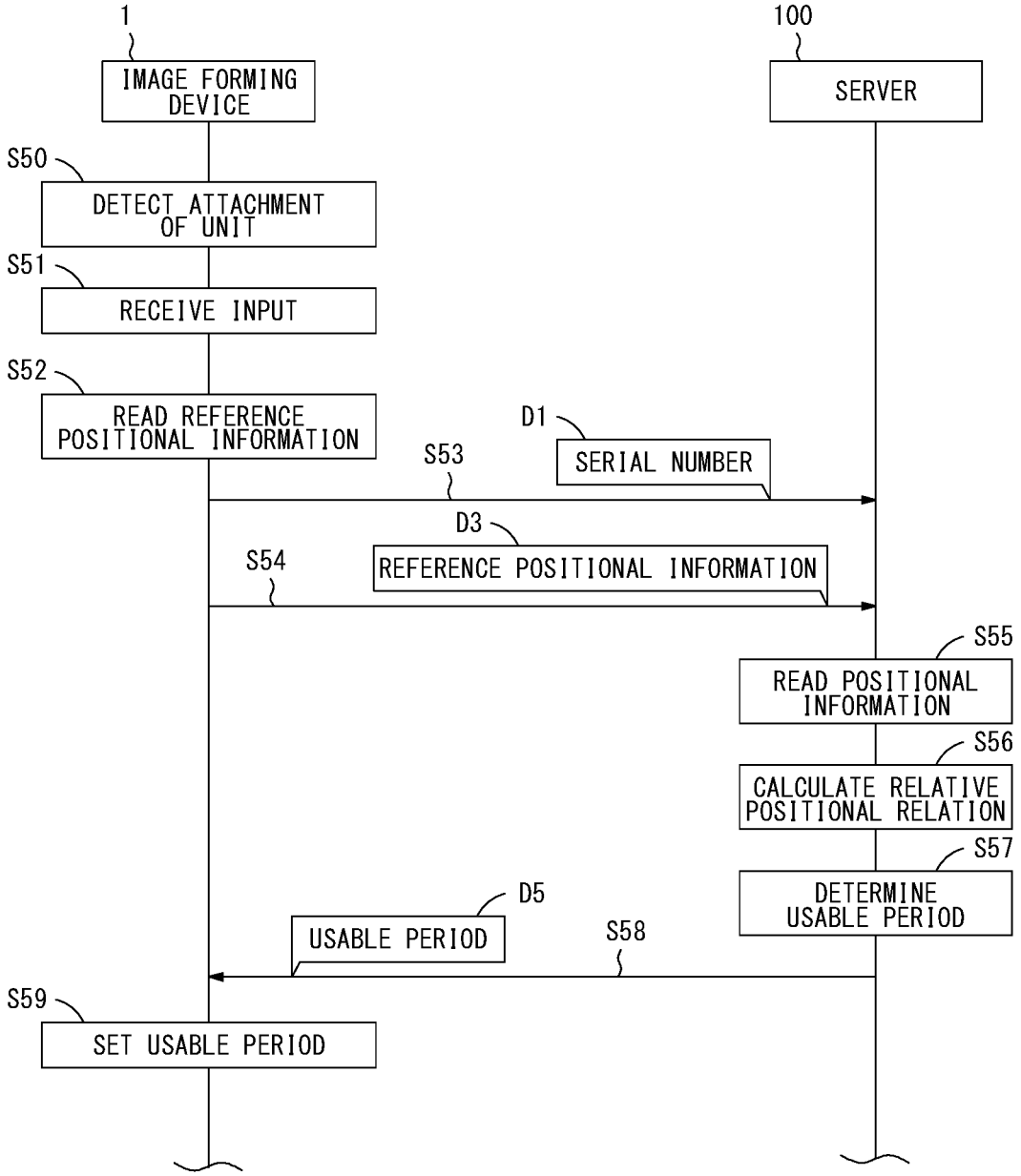
FIG. 11 illustrates a flow diagram explaining an exemplary procedure of the process performed by the image forming device to obtain the usable period from the server.

The image forming device 1 may enable the server 100 to determine the usable period 84 of the image unit 20. FIG. 11 illustrates a flow diagram explaining an exemplary procedure of the process performed by the image forming device 1 to obtain the usable period from the server 100. The process in steps S50 to S56 in FIG. 11 is the same as the process in steps S40 to S46 in FIG. 10. The process is not repeatedly explained.

The server 100 calculates the relative positional relation between the transfer unit 30 and the image unit 20 in the image forming device 1 based on the serial number D1 and the reference positional information D3 received from the image forming device 1. After the calculation, the server 100 determines the usable period of the image unit 20 based on the calculated relative positional relation (step S57). The server 100 sends a usable period D5 determined in step S57 to the image forming device 1 (step S58). Upon receiving the usable period D5 from the server 100, the controller 7 of the image forming device 1 sets the usable period D5 as the usable period 84 of the image unit 20 and stores in the memory 51 (step S59). The structure that enables to determine the usable period of the image unit 20 in the server 100 reduces a load on the image forming device 1.

As described above, once the image unit 20 including the image carrier 21 is attached to the device body, the image forming device 1 of the present embodiment sets the usable period of the image unit 20 based on the relative positional information between the image unit 20 and the transfer unit 30. Thus, the image forming device 1 is enabled to set the correct usable period which reflects the variations in attached positions of each member in the image unit 20 and the transfer unit 30. The image forming device 1, for example, obtains the first positional information 64 related to the image unit 20 and the second positional information 63 related to the transfer unit 30. The image forming device 1 calculates the relative positional relation between the image carrier 21 in the image unit 20 and the primary transfer roller 34 in the transfer unit 30 based on the first positional information 64 and the second positional information 63. The usable period of the image unit 20 can be set based on the calculated relative positional relation, the usable period appropriate for the transfer pressure applied to the image carrier 21 by the primary transfer roller 34 is enabled to be set. Hence, the image forming device 1 of the present embodiment is enabled to set the appropriate replacement period for each image unit 20 attached to the device body.

(Modifications)

While the embodiment of the present invention has been described above, the present invention is not limited to the embodiment. Various modifications may be applied to the present invention.

In the above-described embodiment, for example, the image forming device 1 is constructed by a printer that only includes a printer function. However, this is given not for limitation. The image forming device 1 to which the present invention can be applied does not always have to be the printer. The image forming device 1, for example, may be constructed by a device such as one of MFPs (Multifunction Peripherals) or a facsimile device.

In the above-described embodiment, the server 100 works with the image forming device 1 is installed on the cloud such as internet. The server 100 does not always have to be installed on the cloud such as internet. The server 100, for example, may be installed on a local network. The external device works with the image forming device 1 is not limited to the server.

The program 81 of the above-described embodiment executed by the CPU 50 of the controller 7 is stored in advance in the memory 51. The program 81 may be installed in the image forming device 1 via the communication interface 52, for example. In this case, the program 81 may be provided over internet in a manner that enables a user to download, or may be provided in a manner that is recorded on a computer readable recording medium such as a CD-ROM or a USB memory.

What is claimed is:

1. An image forming device comprising:

an image unit comprising an image carrier;

a transfer unit arranged adjacent to the image carrier; and a controller sets a usable period of the image unit based on a relative positional relation between the image unit and the transfer unit, and wherein the controller further:

obtains first positional information related to the image unit and second positional information related to the transfer unit; and identifies the relative positional relation between the image unit and the transfer unit based on the obtained first and second positional information.

2. The image forming device according to claim 1, wherein the transfer unit comprises an intermediate transfer belt and a primary transfer roller, the intermediate transfer belt is in contact with the image carrier and the primary transfer roller presses the intermediate transfer belt to the image carrier, positional information of the image carrier in the image unit is included in the first positional information, positional information of the primary transfer roller in the transfer unit is included in the second positional information, and the controller calculates the relative positional relation between the image carrier and the primary transfer roller based on the first positional information and the second positional information.

3. The image forming device according to claim 2, wherein information of an outer diameter of the image carrier is further included in the first positional information, and information of an outer diameter of the primary transfer roller is further included in the second positional information.

4. The image forming device according to claim 1, wherein the image unit comprises a first storage in which the first positional information is stored, the transfer unit comprises a second storage in which the second positional information is stored, and the controller obtains the first positional information in the first storage and the second positional information in the second storage.

5. The image forming device according to claim 1, wherein the controller further:

communicates with an external device, wherein the controller communicates with the external device to obtain the first positional information and the second positional information from the external device.

6. The image forming device according to claim 1, wherein the controller:

corrects a default value related to the usable period of the image unit based on the relative positional relation between the image unit and the transfer unit; and determines the usable period of the image unit.

7. The image forming device according to claim 1, wherein the image unit is enabled to be attached to and removed from the image forming device, the transfer unit is enabled to be attached to and removed from the image forming device in a position adjacent to the image unit, and the controller sets the usable period of the image unit based on the relative positional relation between the image unit and the transfer unit upon the attachment of the image unit or the transfer unit to the image forming device.

8. The image forming device according to claim 7, wherein the controller sets the usable period of the image unit based on the relative positional relation between the image unit and the transfer unit upon the attachment of an unused image unit or an unused transfer unit to the image forming device.

9. The image forming device according to claim 7, wherein the controller:

stores a position of a first positioning member, as first reference positional information, which positions the image unit when the image unit is attached to the image forming device;

stores a position of a second positioning member, as second reference positional information, which positions the transfer unit when the transfer unit is attached to the image forming device; and identifies the relative positional relation between the image unit and the transfer unit based on the first reference positional information and the second reference positional information.

10. The image forming device according to claim 1, wherein the controller:

updates a used amount of the image carrier upon driving the image unit and the transfer unit to form an image;

compares the used amount with the usable period; and detects if the replacement time of the image unit has arrived.

11. The image forming device according to claim 10, wherein when a result of the comparison between the used amount and the usable period satisfies a predetermined condition, the controller notifies a user.

12. A setting method to set a usable period of an image unit, the method applied at an image forming device comprising:

the image unit comprising an image carrier; and a transfer unit arranged adjacent to the image unit, wherein the method comprising:

setting the usable period of the image unit based on a relative positional relation between the image unit and the transfer unit;

obtaining first positional information related to the image unit and second positional information related to the transfer unit; and identifying the relative positional relation between the image unit and the transfer unit based on the obtained first and second positional information.

13. The setting method according to claim 12, wherein
the transfer unit comprises an intermediate transfer belt and a primary transfer roller,
the intermediate transfer belt is in contact with the image carrier and the primary transfer roller presses the intermediate transfer belt to the image carrier,
positional information of the image carrier in the image unit is included in the first positional information,
positional information of the primary transfer roller in the transfer unit is included in the second positional information, and
the relative positional relation between the image carrier and the primary transfer roller is calculated based on the first positional information and the second positional information.

14. The setting method according to claim 13, wherein
information of an outer diameter of the image carrier is further included in the first positional information, and
information of an outer diameter of the primary transfer roller is further included in the second positional information.

15. The setting method according to claim 12, wherein
the image unit comprises a first storage in which the first positional information is stored,
the transfer unit comprises a second storage in which the second positional information is stored, and
the first positional information is obtained from the first storage and the second positional information is obtained from the second storage.

16. The setting method according to claim 12, further comprising:
communicating with an external device,
wherein the first positional information and the second positional information is obtained from the external device via the communication with the external device.

17. The setting method according to claim 12, wherein
a default value related to the usable period of the image unit is corrected based on the relative positional relation between the image unit and the transfer unit; and
the usable period of the image unit is determined.

18. The setting method according to claim 12, wherein
the usable period of the image unit is set based on the relative positional relation between the image unit and the transfer unit upon the attachment of the image unit or the transfer unit to the image forming device.

19. The setting method according to claim 18, wherein
the usable period of the image unit is set based on the relative positional relation between the image unit and the transfer unit upon the attachment of an unused image unit or an unused transfer unit to the image forming device.

20. The setting method according to claim 18, wherein
a position of a first positioning member which positions the image unit is stored as first reference positional information when the image unit is attached to the image forming device,
a position of a second positioning member which positions the transfer unit is stored as second reference positional information when the transfer unit is attached to the image forming device, and
the relative positional relation between the image unit and the transfer unit is identified based on the first reference positional information and the second reference positional information.

21. The setting method according to claim 12, wherein
a used amount of the image carrier is updated when the image unit and the transfer unit are driven to form an image,
the used amount is compared with the usable period, and
arrival of the replacement time of the image unit is determined.

22. The setting method according to claim 21, wherein
when a result of the comparison between the used amount and the usable period satisfies a predetermined condition, the user is notified.

23. A non-transitory recording medium storing a computer readable program to be executed by a hardware processor in an image forming device comprising:
an image unit comprising an image carrier; and
a transfer unit arranged adjacent to the image carrier,
wherein the computer readable program causes the hardware processor executing the computer readable program to:
set a usable period of the image unit based on a relative positional relation between the image unit and the transfer unit;
obtain first positional information related to the image unit and second positional information related to the transfer unit; and
identify the relative positional relation between the image unit and the transfer unit based on the obtained first and second positional information.

* * * * *